United States Patent [19]

Smith

[11] 4,080,304

[45] Mar. 21, 1978

[54] HYDROCARBON OIL COMPOSITIONS CONTAINING POLYMERS TO CONTROL VISCOSITY TEMPERATURE RELATIONSHIP

[75] Inventor: Harry A. Smith, Midland, Mich.

[73] Assignee: The Dow Chemical Company, Midland, Mich.

[21] Appl. No.: 730,051

[22] Filed: Oct. 6, 1976

Related U.S. Application Data

[63] Continuation-in-part of Ser. No. 587,498, Jun., 1975, abandoned.

[51] Int. Cl.[2] ..... C10M 1/10

[52] U.S. Cl. ..... 252/49.6; 252/52 A; 252/52 R; 252/56 R

[58] Field of Search ..... 44/62, 77, 80; 252/52 A, 52 R, 56 R, 49.6; 526/279, 320, 332

[56] References Cited

U.S. PATENT DOCUMENTS

| | | | |
|---|---|---|---|
| 2,748,170 | 5/1956 | Benoit, Jr. et al. | 252/52 R |
| 3,037,851 | 6/1962 | Scheule | 44/62 |
| 3,467,634 | 9/1969 | Jacknow et al. | 526/279 |
| 3,803,034 | 4/1974 | Gaydasch | 252/56 R |
| 3,869,396 | 3/1975 | Vandekraats et al. | 252/56 R |
| 4,008,202 | 2/1977 | Evani et al. | 526/320 |

*Primary Examiner*—Daniel E. Wyman
*Assistant Examiner*—Mrs. Y. Harris-Smith
*Attorney, Agent, or Firm*—Albin R. Lindstrom

[57] ABSTRACT

A liquid composition exhibiting reversible solution-/emulsion phase transition to provide a relatively constant viscosity/temperature relationship is provided with a hydrocarbon oil and a minor amount of an interpolymer of at least one hydrocarbon monomer and at least one dispersant monomer having an oil soluble pendant moiety wherein the interpolymer is soluble in the oil above a characteristic transition temperature and wherein the dispersant monomer is in sufficient amount to maintain the interpolymer in a stable colloidal dispersion below that transition temperature.

5 Claims, No Drawings

HYDROCARBON OIL COMPOSITIONS CONTAINING POLYMERS TO CONTROL VISCOSITY TEMPERATURE RELATIONSHIP

CROSS-REFERENCE TO COPENDING APPLICATION

This application is a continuation-in-part of my copending application, U.S. Ser. No. 587,498 filed June 16, 1975, now abandoned.

BACKGROUND OF THE INVENTION

Through the years there has been considerable interest in materials that can be added to fluids such as hydrocarbon oils, as exemplified by lubricating oils, to improve their viscosity/temperature relationships. In this regard it has been well known to employ various polymeric materials as those additives. Included among such polymeric materials are the high molecular weight polymers and copolymers of acrylate and methacrylate esters, styrene, alkylstyrene, and olefins such as isobutylene.

THE PRIOR ART

U.S. Pat. No. 2,572,558 teaches the use of propylated polystyrene for increasing the viscosity index of lubricating oil. The objective is achieved when each styrene unit on the average has at least 1.5 isopropyl substituents.

U.S. Pat. No. 3,318,813 is concerned with improving the viscosity index of lubricating oils with polymers and copolymers of nuclear substituted alkyl styrene where the alkyl group contains from 3 to 8 carbon atoms. The useful polymers are those with a narrow molecular weight distribution.

U.S. Pat. Nos. 3,668,125 and 3,763,044 relate to soluble viscosity index improvers for lubricating oils using block copolymers of hydrogenated monovinyl arene polymers and of alpha olefin polymers or hydrogenated conjugated diene polymers.

Tetrahydrofurfuryl methacrylate polymers used as additives for oil are taught in U.S. Pat. Nos. 3,311,559; 3,311,597; and 3,321,405.

Moderately crosslinked polymers of allyl esters of unsaturated carboxylic acids are employed as oil additives in U.S. Pat. No. 3,222,282.

SUMMARY OF THE INVENTION

The present invention is a liquid composition which exhibits a reversible phase transition between a solution and a colloidal dispersion that is temperature dependent resulting in a relatively constant viscosity over a range of temperature. The composition consists essentially of a hydrocarbon oil and an interpolymer of at least one hydrocarbon monomer, an oil solubilizing monomer and at least one dispersant monomer interpolymerized therein.

The temperature at which the composition passes from a solution to a colloidal dispersion shall be referred to herein as the transition temperature.

The hydrocarbon oils useful herein represent a wide variety of functional fluids, including mineral and synthetic oils, lubricating oil, diesel oil, hydraulic oil, automatic transmission oil and the like.

The useful interpolymers are those composed of an ethylenically unsaturated hydrocarbon monomer including preferably a monoalkenyl aromatic monomer.

Typical of such monomers are styrene and alpha methyl styrene.

The interpolymer must also contain an oil solubilizing monomer. Included within the term, oil solubilizing monomer, are the nuclear alkylated styrene where the alkyl group contains up to about eight carbon atoms. Representative of the latter monomers are vinyl toluene, tertiary butyl styrene and tertiary octyl styrene. The long chain alkyl and oxyalkyl methacrylates having from about 12 to 18 carbon atoms are also useful. Those compounds include lauryl methacrylate and octadecyl methacrylate. Mixtures of such oil solubilizing monomers are also contemplated for use in the invention. Such monomers are characterized in being oil soluble as the monomer and whose homopolymers would be oil soluble. As such the monomers impart the required solubility to the interpolymers.

The dispersant monomer is a bisoluble compound which is interpolymerizable with the hydrocarbon monomer and which, in addition, has a functional moiety that, when interpolymerized with that hydrocarbon and oil solubilizing monomers in minor amount, will cause formation of a stable colloidal dispersion below the transition temperature.

The dispersant monomer may be selected from a wide variety of such compounds. A preferred class of such dispersant monomers are certain vinyl benzyl ethers of the formula:

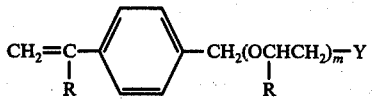

wherein R is hydrogen or methyl, $m$ is about 10 to 100 and Y is $-OR_1$, $-SR_1$,

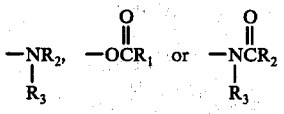

where $R_1$ is an alkyl, aralkyl or alkaryl hydrophobic group of 10 to about 22 carbons atoms, $R_2$ is an alkyl group of 1 to about 22 carbon atoms and $R_3$ is hydrogen or an alkyl group of 1 to about 22 carbon atoms, provided $R_2$ and $R_3$ in combination have at least 10 carbon atoms. The latter dispersant monomers may be prepared by reacting a vinyl benzyl halide having the formula

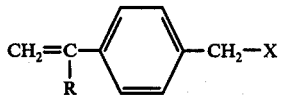

where R is as before and X is a halide, usually Cl or Br, with a nonionic surfactant having the formula

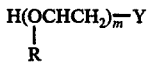

where R, $m$ and Y are as previously defined.

Generally, the nonionic surfactants are prepared by the condensation of ethylene oxide, propylene oxide or mixture thereof with an alkyl, alkaryl, or aralkyl compound having one reactive hydrogen such as alkyl phenols having the formula

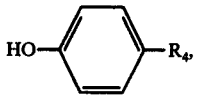

where $R_4$ is octyl, decyl, dodecyl and the like;

$$HN\begin{matrix}R_3\\R_2\end{matrix};\quad R_1COOH;\quad R_1OH;\quad R_1SH;\quad \text{or}\quad R_2\overset{\overset{\displaystyle O}{\|}}{C}NHR_3$$

where $R_1$, $R_2$ and $R_3$ are as previously defined. Typical $R_1$ groups include lauryl, myristyl, cetyl, stearyl, oleyl, linoleyl, 2-phenyldecyl, octyl phenyl, nonyl phenyl and the like. $R_2$ and $R_3$ groups include methyl, ethyl and other alkyl groups as defined for $R_1$. Alkyl phenol-ethylene oxide condensates are preferably employed. It is desirable to employ nonionic surfactants having little or no diol component to minimize formation of divinyl benzyl ethers. A variety of said nonionic surfactants and their preparation are fully disclosed in "Nonionic Surfactants," Vol. 1, edited by M. J. Schick, published by Marcel Decker, Inc. New York, 1967.

The number of oxyalkylene groups $$\left(\underset{\underset{\displaystyle R}{|}}{O}CHCH_2\right)_m,$$

as indicated by *m* should be at least 10 and may be quite large, up to about 100. The oxyalkylene groups may be a mixture of oxyethylene and oxypropylene groups, either heteric or block, but it is preferred that all such groups be oxyethylene groups. Preferably the number of oxyalkylene groups is about 20 to 40.

Another class of useful dispersant monomers is the vinyl silicones.

The composition of the interpolymer will vary with a number of factors including the particular hydrocarbon oil to be stabilized, the temperature range over which control is desired.

The interpolymers may be prepared by known polymerization techniques including bulk, suspension, solution or emulsion polymerization. The advantages and disadvantages of each such technique are well known.

The fluid/polymer compositions are readily prepared by adding the polymer to the fluid, while being stirred, held at a temperature above that at which the polymer is insoluble.

The amount of polymer to be used is the minimum to be effective in controlling the viscosity/temperature relationship of the fluid composition to the extent desired within the temperature range within which control is required. The actual amount used will depend on a number of factors including the polymer composition and molecular weight, the particular fluid, and the requirements of the application of the composition. Generally an amount in the range of from about 1 to 10 weight percent polymer in the composition will suffice. The optimum amount will be readily determined by simple preliminary tests.

It is an advantage of the present concept that the effects are reversible through the range of temperatures for which they are designed. The behavior is in contrast to prior polymeric viscosity controlling agents which functioned in that capacity throughout the temperature range in which they were insoluble but below which they settled out of solution. When settled out of solution not only is such a polymer incapable of exerting influence on the viscosity of the oil but in addition presents problems of clogging filters, small oil lines and like mechanical devices. The stable colloidal dispersion of this invention results in particles of submicron size which continue to exert an influence on the oil but minimize the mechanical difficulties.

The invention is illustrated in the following examples wherein all parts and percentages are by weight.

EXAMPLE 1

(Polymer Preparation)

A. A mixture of 30 gms of styrene, 87.6 gms of t-butylstyrene, 2.4 gms of dispersant monomer, and 0.12 gms of benzoyl peroxide was made up in a citrate bottle, flushed with nitrogen, and capped. The capped bottles were then placed in a tumbler at 80° C for 4 days, cooled, and removed. The polymer so obtained was removed from the bottles and ground. Such polymers contain 25% styrene by weight and 2% dispersant monomer and have a weight average molecular weight of $4.5–5.5 \times 10^5$.

B. In a similar manner, polymers containing 30% styrene and 0%, 5% and 10% dispersant monomer were prepared.

EXAMPLE 2

A. Solutions of the polymers made in the above Example 1 were made up in transmission oils sold commercially as Amoco SAE 40 oil and Citgo Calumet 3500 oil and the behavior of viscosity of these systems with temperature determined as well as the polymer precipitation temperature and the nature of the precipitate (phase separated or dispersed). This data is given in the tables below for 2.5% and 5% solutions.

TABLE I

| Polymer S/tBs | Emulsifier | % Emulsifier | Molecular Weight $\times 10^5$ | $T_{ps}$[a] °C | η210° F | η100° F | Room Temperature Pourability & Dispersion |
|---|---|---|---|---|---|---|---|
| 2.5% SOLUTIONS | | | | | | | |
| (C-3500 oil) 75/25 | vinyl silicone | 0 | 3.5 | 55 | 7.4 | 12.0 | Yes - fluid-polymer precipitated |
| | | 2 | 4.9 | 62 | 11.6 | 21.4 | Yes - well dispersed. |
| | | 5 | 6.95 | 63 | 18.5 | 16.4 | Yes - well dispersed. |
| (SAE-40 oil) 25/75 | vinyl silicone | 0 | 4.1 | 54 | 52.0 | 282 | None - polymer precipitated. |
| | | 2 | 3.7 | 54 | 48.2 | 275 | Yes - very fluid if agitated - well dispersed. |
| | | 5 | 4.1 | 60 | 50.8 | 520 | Yes - very fluid if agitated - well dispersed |
| | | 10 | 3.75 | 65 | 49.0 | 332 | Yes - very fluid if agitated |

TABLE I-continued

| | | | | | | | |
|---|---|---|---|---|---|---|---|
| VBE[b] | | 0 | 4.1 | 54 | 52.0 | 282 | - well dispersed<br>None - polymer precipitated |
| | | 2 | 5.2 | 62 | 59.4 | 628 | Yes - fluid if agitated<br>- well dispersed |
| | | 5 | 5.45 | 87 | 56.8 | 646 | Yes - very fluid if agitated<br>- well dispersed. |
| | | 10 | 2.1 | 100 | 38.4 | ~270 | Yes - polymer precipitated. |

5% SOLUTIONS

| Polymer S/tBs | Emulsifier | % Emulsifier | Molecular Weight $\times 10^5$ | $T_{ps}$[a] °C | η210° F | η100° F | Room Temperature Pourability & Dispersion |
|---|---|---|---|---|---|---|---|
| (SAE-40 oil) 25/75 | | 0 | 4.5 | 62 | 125 | 281 | No - polymer precipitated. |
| | vinyl silicone | 2 | 3.7 | 62 | 108 | 354 | Yes - especially if agitated<br>- well dispersed. |
| | VBE[b] | 2 | 5.3 | 75 | 138 | 267 | Yes - especially if agitated<br>- well dispersed. |
| | OD-E1800[c] VBE | 2 | 5.6 | 74 | 148 | 279 | Some - well dispersed. |
| 30/70 | vinyl silicone | 0 | 4.1 | 79 | 117 | 357 | No - polymer precipitated. |
| | | 2 | 3.5 | 80 | 105 | 331 | Yes - especially if agitated. |
| | VBE[b] | 2 | 6.0 | 97 | 158 | 272 | Yes - especially if agitated. |
| | OD-E1800 VBE[c] | 2 | 5.6 | 92 | 147 | 264 | Some - well dispersed. |

[a]Temperature of Polymer Precipitation.
[b]Vinyl benzyl ether of condensation product of nonyl phenol and 40 moles ethylene oxide.
[c]Vinyl benzyl ether of polyoxyethylene (M.W. 1800) monooctadecyl ether.

From the data it can be seen that solutions of the polymers containing internal surfactants have viscosities at 210° F that are comparable to those without surfactant and comparable viscosity indexes. However, on precipitation of the polymer at temperatures below "$T_{ps}$", the resulting mixture remains homogeneously dispersed in the cases of the emulsified systems with one exception, whereas the unemulsified systems allow the polymer to separate out which could lead to plugging of filters and small passages in equipment through which these mixtures might pass.

What is claimed is:

1. A liquid composition exhibiting reversible solution-/emulsion phase transition to provide a constant viscosity/temperature dependence, said composition comprising a lubricating oil and a minor amount of an interpolymer of at least one hydrocarbon monomer, selected from the group consisting of styrene and alpha methyl styrene, an oil solubilizing monomer selected from the group consisting of nuclear alkylated styrene wherein the alkyl group contains up to about eight carbon atoms and alkyl methacrylates having from 12 to 18 carbon atoms and oxyalkylmethacrylates having from 12 to 18 carbon atoms and at least one dispersant monomer having an oil soluble pendant moiety and selected from the group consisting of vinyl silicones and vinyl benzyl ethers having the formula:

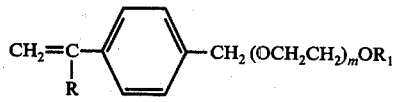

wherein R is hydrogen or methyl, *m* is about 10 to 100 and $R_1$ is an alkyl, alkaryl, or aralkyl group of 10 to about 22 carbon atoms, said interpolymer being soluble in said oil above a characteristic temperature and said dispersant monomer being present in said interpolymer in sufficient amount to maintain any insolubilized interpolymer below said characteristic temperature in stable colloidal dispersion.

2. The composition of claim 1 wherein $R_1$ is an alkyl phenyl group and R is hydrogen.

3. The composition of claim 1 wherein R is hydrogen and $R_1$ is an alkyl group of 18 carbon atoms.

4. The composition of claim 1 wherein said alkyl styrene is t-butyl styrene.

5. The composition of claim 1 wherein said interpolymer is composed of said dispersant monomer, an alkyl methacrylate having from 12 to 18 carbon atoms in the alkyl group, and styrene.

* * * * *